United States Patent [19]

Walton

[11] 4,033,314

[45] July 5, 1977

[54] METERING CONTROL

[75] Inventor: Erlen B. Walton, Farmington Hills, Mich.

[73] Assignee: Eaton Corporation, Cleveland, Ohio

[22] Filed: Aug. 8, 1975

[21] Appl. No.: 603,078

[52] U.S. Cl. ..... 123/139 R; 123/139 AW; 123/139 E; 137/624.13; 137/624.15; 137/625.69

[51] Int. Cl.[2] ..... F02M 39/00

[58] Field of Search ..... 123/32 F, 32 G, 139 AB, 123/139 AF, 139 AD, 139 E, 139 AE, 139 R, 139 AW, 137, 140 A; 137/624.13, 624.15, 625.25, 625.69; 222/70, 561

[56] References Cited

UNITED STATES PATENTS

| | | | |
|---|---|---|---|
| 2,077,259 | 4/1937 | Planiol | 123/139 E |
| 2,147,390 | 2/1939 | Vandet | 123/139 AD |
| 2,502,989 | 4/1950 | Rathbun | 123/32 G |
| 2,750,933 | 10/1956 | Lauch | 123/139 |
| 2,880,760 | 4/1959 | Widell et al. | 137/624.15 |
| 2,898,937 | 8/1959 | Williams | 137/624.13 |
| 3,119,381 | 1/1964 | Cummins | 123/139 AF |
| 3,313,846 | 5/1967 | Bender | 137/624.15 |
| 3,505,984 | 4/1970 | Mansfield | 123/139 R |
| 3,752,137 | 8/1973 | Kimberley | 123/32 G |
| 3,779,225 | 12/1973 | Watson et al. | 123/139 E |
| 3,797,469 | 3/1974 | Kobayashi et al. | 123/139 E |
| 3,827,832 | 8/1974 | Faupel et al. | 123/139 AD |
| 3,837,324 | 9/1974 | Links | 123/139 E |

FOREIGN PATENTS OR APPLICATIONS

| | | | |
|---|---|---|---|
| 2,044,841 | 3/1972 | Germany | 123/139 R |

*Primary Examiner*—Carroll B. Dority, Jr.
*Assistant Examiner*—Paul Devinsky
*Attorney, Agent, or Firm*—Teagno & Toddy

[57] ABSTRACT

A dual metering valve for a diesel engine pilot fuel injection system. The dual valve includes a pilot fuel metering valve, a main fuel metering valve, and a logic system. The pilot and main valves are of the spool type and each includes a solenoid for axially moving the spool from an unactuated position to an actuated position and a spring which returns the spool to an unactuated position when the solenoid is de-energized. The logic system controls the supply of unmetered fuel to a chamber in each spool and utilizes the position of the spools to provide the logic control. When the main spool is in its unactuated position it ports unmetered fuel to the pilot spool chamber; when the main spool is in its actuated position it blocks the supply of unmetered fuel to the pilot spool chamber. Pilot spool control is the reverse of the main spool control; i.e., when the pilot spool is in its unactuated position it blocks the supply of unmetered fuel to the chamber in the main spool; when the pilot spool is in its actuated position its ports unmetered fuel to the main spool chamber. The logic allows fuel metering when the spools move from their unactuated positions to their actuated positions. The logic prevents fuel metering when the spools move from their actuated positions to their unactuated positions. The pilot and main spools are each provided with a diaganol shoulder and means to vary the angular position of the spools and diagonal shoulders to control amounts of fuel metered by the valves.

23 Claims, 6 Drawing Figures

First
Second

METERING CONTROL

CROSS-REFERENCE

The application is related to copending application Ser. No. 594,832, filed July 10, 1975 and contains claims generic to the fuel metering return disclosed therein and claimed in combination with the fluid distributor logic also disclosed therein.

BACKGROUND OF THE INVENTION

1. Field of the Invention

This invention relates to a pilot fuel injection valve for an internal combustion engine and more specifically to means for controlling the amount of fuel metering by the valve.

2. Description of the Prior Art

The advantages of fuel injection are well known. The degree with which the advantages are obtained is governed greatly by the accuracy and timing flexibility of the metering valve or valves in an injection system and ultimately by the cost of the metering valves and system for controlling the valves. U.S.patent application Ser. No. 403,308, filed Oct. 3, 1973 now abandoned and Div. thereof Ser. No. 389,391 filed May 24, 1976 and assigned to the assignee of this application, discloses a spool type valve capable of metering very small and accurate pilot and main fuel charges to the cylinders of an engine. The valve of application Ser. No. 403,308 employs the concept of metering fuel only while momentarily defining a continuous passage through the valve by traversing a passage in the spool across an outlet passage in the housing. The spool velocity is independent of engine speed; the velocity is preferably the same for all engine speeds and loads. Further, metering is started and stopped without reversing the spool velocity by completely traversing the passage. The traversing feature allows very small and accurate metering of the fuel charges. The features of the same spool velocities for all engine conditions and not reversing direction of the spool during metering allows the use of simple and inexpensive means to control movement of the spool. Further, since direction of the spool is not reversed during metering, spool actuating forces are maintained relatively low. This improves the wear life of the valve, since high actuating forces adversely effect long wear life.

The valve of application Ser. No. 403,308 discloses a throttle controlled sleeve for varying the cross-sectional area of the traversed housing passage, thereby controlling the amount of fuel metered during the traversing time of the passage. This method of controlling the amount of fuel metered adds cost and complexity to the valve and does not readily provide the feature of abruptly lowering pressure of the fuel in the outlet following metering. This feature is desirable since it prevents dribble at the injection nozzle connected to the outlet.

SUMMARY OF THE INVENTION

An object of this invention is to provide a simple and low cost valve capable of metering a very small and accurate charge of fluid.

Another object of this invention is to provide a fluid metering valve which is readily controlled to vary the amount of fluid in each charge metered by the valve.

Another object of the invention is to provide a fluid metering valve which abruptly lowers the pressure of the fluid at its outlet following metering of the fluid to the outlet.

A more specific object of the invention is to provide a high pressure fluid metering valve which controls the amount of high pressure fluid metered through its outlet by abruptly lowering the pressure of the fluid in the outlet.

According to a feature of this invention, the above objects are provided by a valve having a housing defining an inlet and an outlet port, a return passage, and a valving member which moves along a path extending from a first position blocking communication between the ports to a second position which may either block or allow the communication. The valving member includes a passage which is operative at some point along the path to meter fluid to the outlet by defining a continuous passage through the valve by serially connecting the inlet port with the outlet port. Effective fluid metering is terminated by connecting one of the ports with the return passage at some point during valving member movement along the path and the amount of effective metering is controlled by varying the point along the path at which the port is communicated with the return.

According to another feature of this invention the last of the above objects is specifically provided by connecting the outlet port with the return passage to terminate effective metering and abruptly lowering fluid pressure in the outlet.

BRIEF DESCRIPTION OF THE DRAWINGS

The preferred embodiment of the invention is shown in the accompanying drawings in which.

DESCRIPTION OF THE PREFERRED EMBODIMENT

Figure 1:
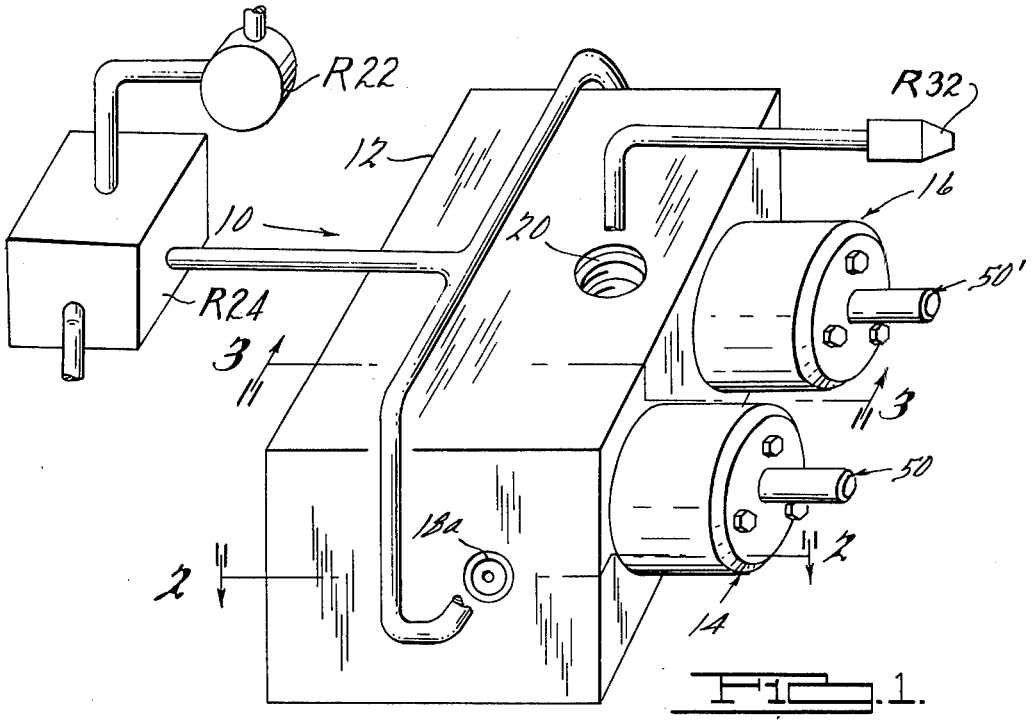
FIG. 1 is a schematic pictorial view of a dual metering valve.

FIG. 1 is a perspective view of a dual metering valve 10 having a housing 12 in which is disposed, in a parallel relationship, a main fuel metering valve 14 and a pilot fuel metering valve 16. Metering valves 14 and 16 include rotatable shafts 50 and 50' for varying the amount of fuel metered by the valves in proportion to throttle movement. Housing 12 has four external fuel ports consisting of inlet ports 18*a* and 18*b* (18*b* is shown only in FIG. 2), an outlet port 20, and a return port 22 (22 is shown only in FIG. 3). Valve 10 is adapted for installation in a pilot fuel injection system for a compression ignition engine. However, dual valve 10 may be used in any system requiring a valve having the capability of accurately metering pulses of fluid.

The dual metering valve 10 is adapted for installation in the pilot fuel injection systems disclosed in U.S. Pat. application Ser. No. 403,308 filed Oct. 3, 1973, and assigned to the assignee of this application. Application 403,308 is incorporated herein by reference. Dual valve 10 is particularly adapted for installation in the system of FIG. 1 of the referenced application. The manner in which dual valve 10 is installed in the system of FIG. 1 requires a brief explanation. In this explanation reference numerals of the referenced application will be prefixed by an R for purposes of clarity and the system components are shown schematically. The installation of valve 20 into the system of FIG. 1 of the reference to application is as follows: distributor R26 is dispensed with, a dual valve 10 provided for each cylinder of the engine in lieu of dual valves R28*a*, R28*b*, etc., inlet ports 18*a* and 18*b* are connected directly to accumulator R24 which is provided with pressurized fuel from pump R22, outlet port 20 is connected to injection nozzle R32 (not shown), and shaft R42 is connected to shafts 50 and 50' in any well know manner such as by a rack and pinion.

Figure 3:
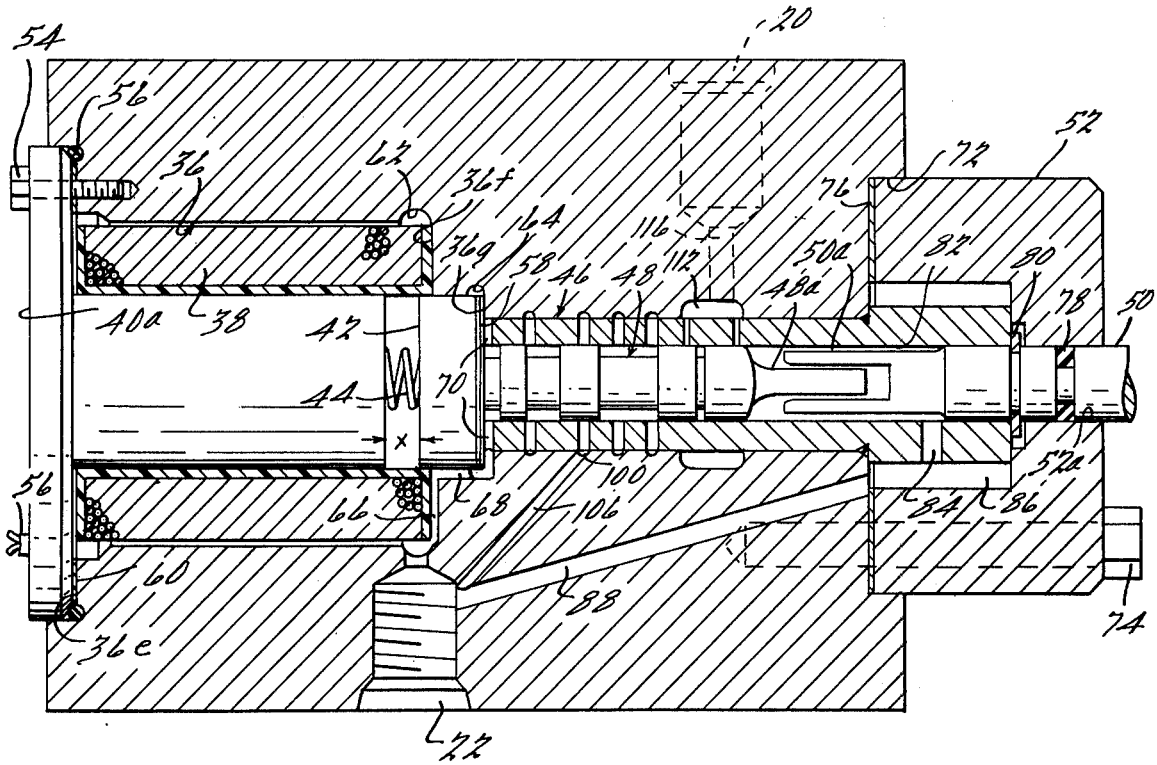
FIGS. 2 and 3 are sectional views of the dual valve in FIG. 1 looking in the direction of arrows 2 and 3, respectively.

The main and pilot fuel metering valves are solenoid actuated spool valves and each performs two functions: The pilot valve meters a pilot fuel charge to the engine cylinder via port 20 and controls the supply of unmetered high pressure fuel to the fuel metering portion of the main fuel metering valve. The main valve meters a main fuel charge to the engine cylinder via port 20 and controls the supply of unmetered high pressure fuel to the metering portion of the pilot fuel metering valve. Control of the unmetered high pressure fuel supply by each valve to the fuel metering portion of the other valve forms what is called herein, a fuel distributor logic or logic system. This system comprises a logic section in the pilot and main valving assemblies of the pilot and main metering valves and transfer passages in housing 12 which interconnect the valving assemblies. The structure for performing the metering and logic functions is best seen in FIGS. 2 and 3.

Figure 2:
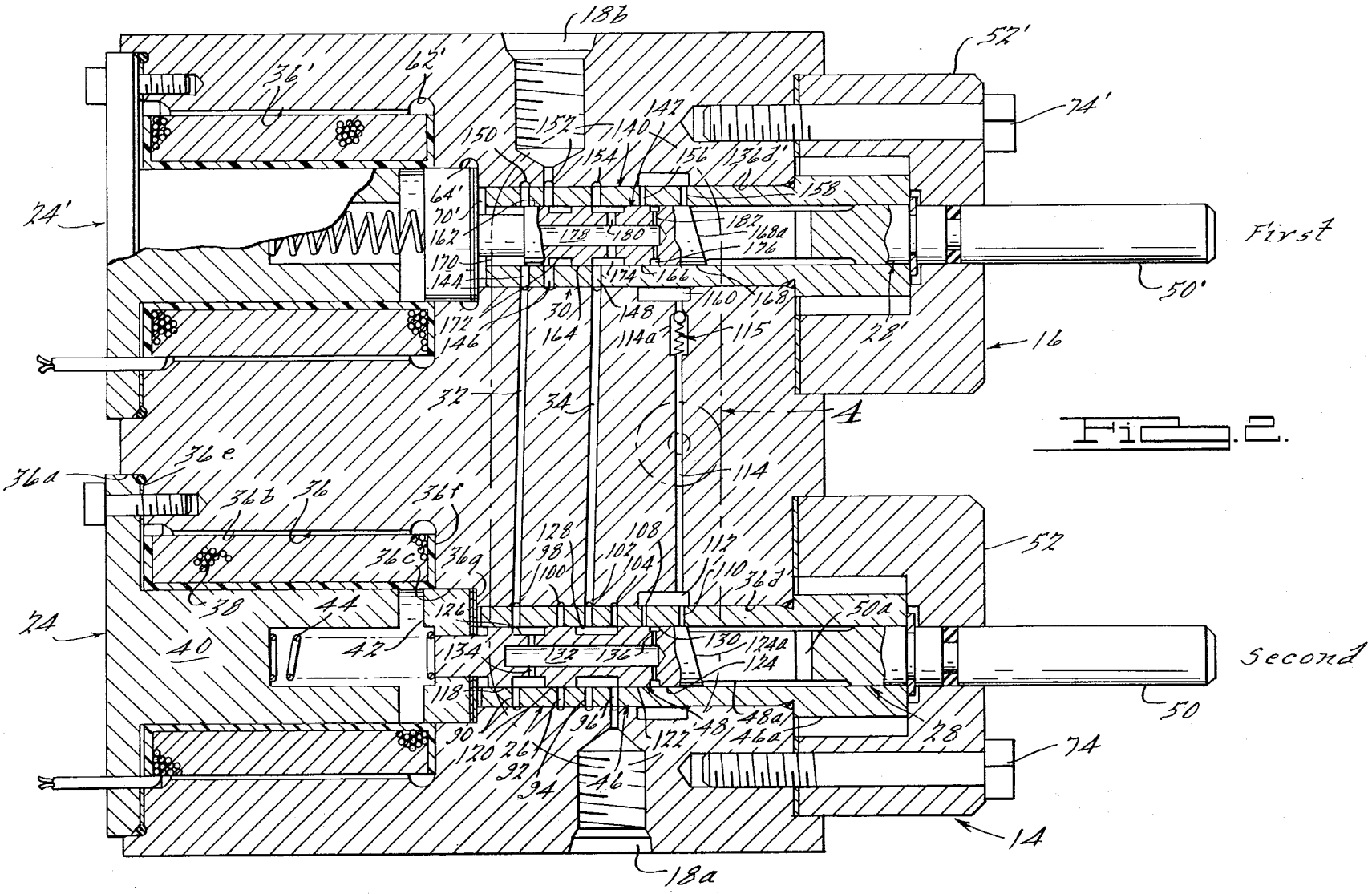

Looking first at FIG. 2, a main metering valve 14 includes a solenoid assembly 24, a main fuel valving assembly 26, and a spool rotating assembly 28. Main valving assembly 26 includes a fuel metering section and a fuel logic section, which sections are formed by passage in the valving assembly; the passages will be structurally described and then grouped according to their metering and logic function.

The metering valves 14 and 16 differ only with respect to passage arrangement in the logic sections and passage size in the metering sections of the valving assemblies. Hence, a detailed description of the solenoid and spool rotating assemblies of the main valve assembly 14 will suffice for both valves. Numerals used to identify portions of the solenoid and spool rotating assemblies in the main valve assembly will be given a prime to identify portions in the pilot valve assembly which are identical and necessary for description clarity. The valving assemblies of the pilot and main metering valves will be identified by different numerals.

Pilot valve 16 includes a solenoid assembly 24', a pilot fuel valving assembly 30, and a spool rotating assembly 28'. Pilot valving assembly 30 includes a fuel metering section and a fuel logic section, which sections are formed by passages in the valving assembly; these passages will be identified in the same manner as the corresponding passage in the main valving assembly.

The metering section in main valving assembly 26 communicates with the logic section in pilot valving assembly 30 via a transfer passage 32. The meterinng section in pilot valving assembly 30 communicates with the logic section in main valving assembly 26 via a transfer passage 34.

Solenoid assembly 24, main valving assembly 26, and spool rotating assembly 28 of the main metering valve 14 are disposed in a stepped bore portions 36*a*, 36*b*, 36*c* and 36*d*. The bore portions define shoulders 36*e*, 36*f*, and 36*g*. Solenoid assembly 24 is disposed in bore portions 36*a*, 36*b*, and 36*c* and includes a coil 38, an iron core 40, an armature 42, and a spring 44. Valving assembly 26 is disposed in bore portion 36*d* and includes a sleeve 46 and a spool or valving member 48. Spool rotating assembly 28 is partly disposed in bore portion 36*d* and includes a tang portion 48*a* formed on the right end of spool 48 and best seen in FIG. 3, a sleeve portion 46*a* which protrudes from the right end of bore portion 36*d*, the shaft 50, and a cup shaped cover 52. Shaft 50 includes a forked end 50*a* which slideably receives tang portion 48*a*, as best seen in FIG. 3.

Further features of the solenoid and spool rotating assembly, which are also the same for the main and pilot metering valves, will now be explained with references to the main valve shown in FIG. 3. Iron core 40 includes a flange portion 40*a* which is secured to housing 12 by a plurality of bolts 54, one of which is shown. An O-ring 56 seals bore 36 at the left end. Coil 38 is cylindrical and is encapsulated in a synthetic material which insulates the coil wires from fuel. A pair of lead wires 56 from the coil pass through a hole in flange 40*a*. Armature 42 may be securely fixed to the left end of spool 48 or formed therewith. The axial position of spool 48 in sleeve 46 is determined by a plurality of shims 58 which are disposed between armature 42 and shoulder 36*g*. Spool 48 is biased toward its unactuated or first position by spring 44. The air gap "X", between core 40 and armature 42, may be controlled by a second set of shims 60 which are disposed between flange portion 40*a* and shoulder 36*e*. The dimension of gap "X" is critical to valve operation, since spool 48 meters fuel only when it is moving. Hence, the velocity of the spool is directly related to the amount of fuel metered. This velocity is influenced by the initial electro magnetic force applied to the armature. The biasing force of spring 44 also influences the velocity of the spool. Hence, the biasing force must be closely controlled. The biasing force may be controlled by selecting springs within some defined limits or by providing an adjustment for varying the biasing force, such as an adjustment screw which could extend through iron core 40.

Leakage fuel from spool 48, which may get into the area occupied by the solenoid assembly, is drained into return port 22 by a pair of annular grooves 62 and 64, passages 66, and 68, and vertically extending notches 70 in the left end face of sleeve 46.

The cover 52 of spool rotating assembly 28 is received by a recess 72 in housing 12, is secured to the housing by a plurality of bolts 74 (one of which is shown in FIG. 2), and is sealed by a gasket 76. Shaft 50 is rotatably supported by a bore 52*a* in cover 52, is sealed by an O-ring 78, and is axially retained by a snap ring 80. Tang 48*a* and fork 50*a* are necked down to provide an annular passage 82 for communicating dumped fuel from the metering section of the main valving assembly to return port 22 via a passage 84, an annular chamber 86, and a passage 88. The right end of shaft 50, is adapted to be connected to an unshown throttle linkage system so that the amount of fuel metered can be controlled as a function of throttle position. On a multi-cylinder engine a single valve housing may contain a pilot valve and main valve for each cylinder. The pilot and main valve may then be arranged so that their shafts 50 are in parallel alignment. The parallel aligned shafts may then be rotated in unison by a rack and pinion gear system operated by the throttle.

The features of the main valving assembly 26 and the pilot valving assembly 30 will now be described with reference to FIG. 2. Sleeve 46 of valving assembly 26 is pressed into bore portion 36*d*. Sleeve 46 includes four sets of radially extending passages 90, 92, 94 and 96 which communicate, respectively, with four annular grooves 98, 100, 102 and 104 in bore portion 36*d*. Grooves 98 and 102 communicate, respectively with transfer passages 32 and 34. Groove 100 communicates with return port 22 via a passage 106, as shown in FIG. 3. Groove 104 communicates with inlet 18*a*. Sleeve 46 also includes a pair of fuel metering passages 108 and 110 which communicate with an annular groove 112. Groove 112 communicates with outlet port 20 via passages 114 and 116, as shown in FIGS. 2 and 3 together.

Spool 48 includes four lands 118, 120, 122 and 124, three annular grooves 126, 128 and 130, and a tubular chamber 132. Chamber 132 communicates with grooves 126 and 130, via two pairs of passages 134 and 136, respectively. The right shoulder 124*a* of land 124 is diagonally formed with respect to the axis of the spool to control the amount of fuel metered by the metering section in response to the rotational position of the spool. Spool 46 is shown in a position which will provide or meter a minimum amount of fuel, since diagonal shoulder 124*a* will start to uncover metering or dump passage 110 as groove 130 starts to traverse passage 108, thereby porting the high pressure fuel to return port 22 via annular passage 82, etc.

Grooves 98, 100, 102 and 104, passages 90, 92, 94 and 96, lands 118, 120 and 122, and grooves 126 and 128 form the logic section of main valving assembly 26. Passages 134, tubular chamber 132, passages 136, groove 130, passage 108, groove 112, passage 110, and diagonal shoulder 124*a* form the metering section of main valving assembly 26.

Pilot valving assembly 30 includes a sleeve 140 pressed into bore portion 36*d'* and a spool or valving member 142. Valving assembly 30 is functionally the same as valving assembly 26 and differs therefrom only with respect to passage sizes and arrangements. Several different passage arrangements are possible.

Sleeve 140 includes three sets of radially extending passages 144, 146 and 148 which communicate, respectively, with transfer passages 32 and 34. Groove 152 communicates with inlet passage 18*b*. Sleeve 140 also includes a pair of metering passages 156 and 158 which communicate with an annular groove 160. Groove 160 communicates with outlet port 20 via the passages 114 and 116, as shown in FIGS. 2 and 3 together. An end 114*a* of passage 114 includes a check valve 115 which allows free flow from annular groove 160 to the outlet port and prevents reverse flow.

Spool 142 includes four lands 162, 164, 166 and 168, four annular grooves 170, 172, 174 and 176, and a tubular chamber 178. Chamber 178 communicates with grooves 174 and 176, respectively, via two pairs of passages 180 and 182. The right shoulder 168*a* of land 168 is diagonally formed with respect to the axis of the spool to control the amount of pilot fuel metered in the same manner as the amount of metered fuel is controlled by the main valving member. Groove 170 communicates with return port 22 via a notch 70' grooves 64' and 62', and passages 66' and 68'. Passages 66' and 68' are not shown in FIG. 2, but have the same positional relationship as their counterparts for the main valve, as shown in FIG. 3.

Grooves 150, 152, and 154, passages 144, 146 and 148, lands 162, 164, and 166, grooves 170, 172 and 174 form the logic section of pilot valving assembly 30. Passages 180, tubular chamber 178, passages 182, groove 176, passages 156, groove 160, passage 158, and diagonal shoulder 124*a* form the metering section of pilot valving assembly 30.

OPERATION

In a fuel injection system having one dual valve 10 per engine cylinder, the pilot and main metering valves are each actuated once per engine cycle. The pilot and main valves are normally actuated during the compression stroke. Actuation of the pilot metering valve precedes actuation of the main metering valve by some number of crankshaft degrees, for example 40°. The number of degrees may be varied as a function of engine operating conditions, such as rpm and throttle position. Systems for actuating the valves was a function of these conditions are well known in the art.

For purposes of explanation the spool of each metering valve will be described with respect ot its static or dynamic axial position in the sleeve of each metering valve. When the spools are static and fully to the right they are in their first or unactuated positions. When the spools are static and fully to the left they are in their second or actuated positions. When the spools are dynamic and moving to the left they are in the actuation strokes. Whhen the spools are dynamic and moving to the right they are in the deactuation strokes. The logic system uses the logic section of one valving assembly to control the pressurizing and venting of the metering sections in the other valving assembly when the spools are in their static position.

Figure 4:
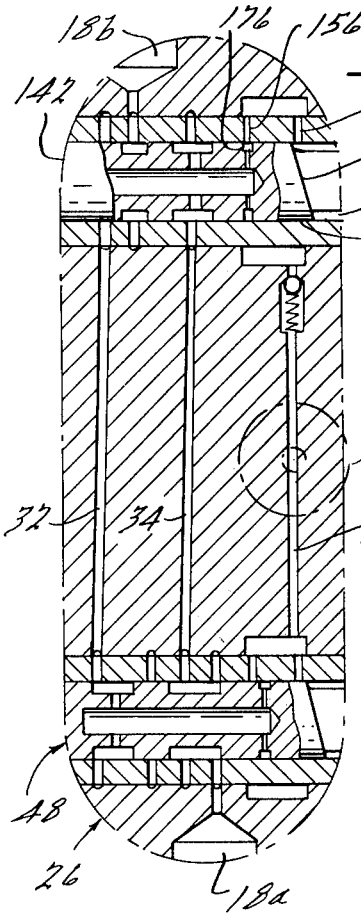
FIGS. 4, 4A and 4B are views showing various positions of the valving member of FIG. 2.

When spool 48 of main valving assembly 26 is in its unactuated position, i.e., to the right as shown in FIG. 2, groove 128 of the logic section connects the pilot metering section with unmetered high pressure fuel at inlet port 18*a* via groove 104, passage 96, groove 128, passages 94, groove 102, transfer passage 34, groove 154, passage 148, and groove 174; in this spool position land 120 of the logic section blocks passages 92 and prevents venting of the pilot metering section. Hence, fuel may be metered by the pilot metering section, when spool 142 is being moved to the left. FIG. 4 shows spool 142 during its actuation stroke with groove 176 registered with passage 156. However, no fuel is being delivered to outlet port 20, since land 168 has already uncovered passage 158 due to the rotational position of diagonal shoulder 68*a*, thereby porting the pressure fuel to return port 22 via annular passage 82', etc.

The amount of effective fuel metered to outlet 20, i.e., fuel at a pressure high enough to open an injection nozzle which would be connected to the outlet, is controlled by varying the rotational or angular position of the spool 142 in sleeve 140. This varies the axial relationship between passage 158 and diagonal shoulder 168*a*, thereby varying, during the actuation stroke the point at which the pressure of the fuel is annular groove is abruptly lowered by connecting passage 158 to return. The slope of diagonal shoulder 168*a* and the rotational limits of the spool are such that passage 158 may be connected to return before groove 176 communicates with passage 108, whereby no effective fuel is metered, or passage 158 may be connected to return after groove 176 has completely traversed passage 108, whereby a maximum amount of effective fuel is metered. Amounts of effective fuel in between the upper and lower limits are provided by connecting passage 158 to return while groove 176 is traversing passage 156. Further, groove 176 does not necessarily have to completely traverse passage 108 to provide a maximum amount of effective fuel. The spool could be arranged to stop while groove is still communicating with passage 108; this arrangement would port greater amounts of fuel to return unless means are provided to block the flow of pressurized fuel to chamber 178 of the spool.

Figure 4A:
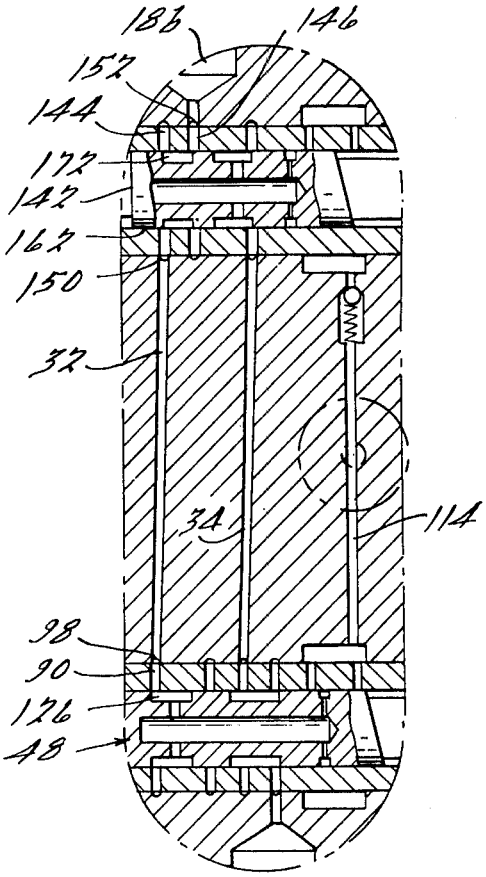

Spool 142 is shown in its actuated position in FIG. 4A, i.e., the spool is to the left. When in this position, groove 172 of the logic section connects the main metering section with unmetered high pressure fuel at inlet 18*b* via grooves 152, passages 146, groove 172, passages 144, groove 150, transfer passage 32, groove 98, passages 90, and groove 126; in this position land 162 of the logic section prevents venting of the main metering section. Hence, fuel may be metered by the main metering section when spool 48 is moved to the left.

Figure 4B:
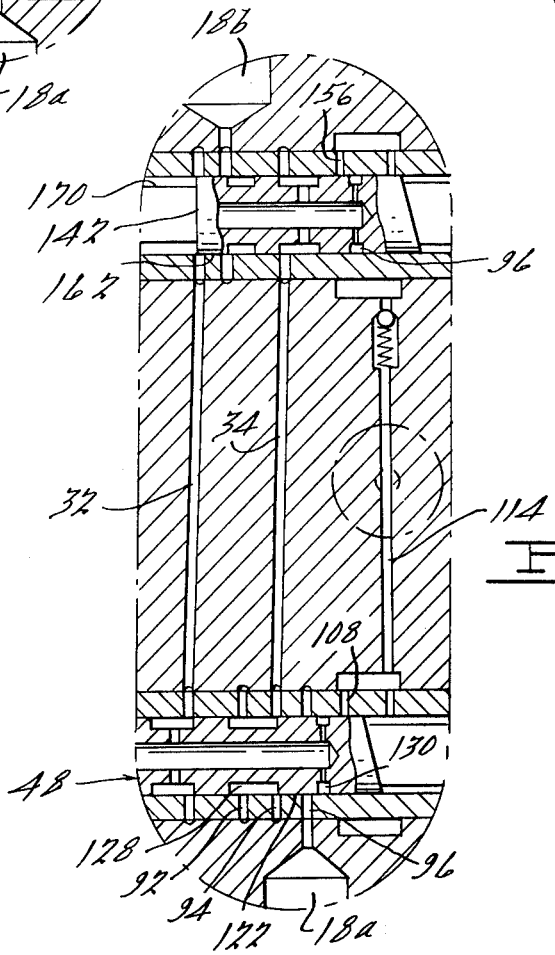

Spool 48 is shown in its actuated position in FIG. 4B, i.e., the spool is to the left. When in this position land 122 covers passages 92 and groove 128 communicates passages 96 with passages 94 thereby, respectively, blocking fuel communication between inlet port 18*a* and the pilot metering section and venting the pilot metering section to return 22. Hence, spool 142 may be returned to its inactivated position without fuel metering as groove 176 traverses passages 158. When spool 142 is in its unactuated position, as shown in FIG. 4B, land 162 prevents fuel communication between inlet port 18*b* and the pilot metering section and groove 170 vents the main metering section to return via notches 70', groove 64', etc., as shown in FIG. 2. Hence, spool 48 may be returned to its unactuated position without fuel metering as groove 130 traverses passages 108.

The preferred embodiment of the invention has been disclosed for illustrative purposes. Many variations and modifications of the preferred embodiment are believed to be within the spirit of the invention. The following claims are intended to cover the inventive portions of the preferred embodiment and variations and modifications within the spirit of the invention.

What is claimed is:

1. A metering valve comprising:

a valve housing having a fluid inlet port, a fluid outlet port, and a fluid return passage;

a valving member moveable in said housing along a path extending from a first position to a second position, said valving member operative when in said first position to block communication between said ports and between said return passage and either of said ports;

passage means in said valving member operative at some point during said movement of said valving member along said path to define a continuous passage through said valve housing by serially connecting said inlet port, said passage means, and said outlet port; and means for communicating one of said ports with said return passage at some point during such movement.

2. The metering valve of claim 1, further including:

means for varying the point along said path at which said one port is communicated with said return passage.

3. The metering valve of claim 2, wherein:

said valve housing includes a bore and said inlet and outlet ports and said return port communicate with said bore;

said valving member is a spool valving member having first and second lands in slideable sealing contact with the wall of said bore and axially spaced apart by said passage means in said spool, said first land operative to block communication between said passage means and one of said ports when said spool is in said first position and said second land operative to block communication between said one port and said return passage when said spool is in said first position;

said communicating means including a diagonal shoulder defined by said second land and operative to communicate said one port to return at some point during axial movement of said spool along said path; and said varying means includes means for varying the rotational position of said spool in said bore, thereby varying the point said diagonal shoulder connects said one port to return while said spool is moving axially along said path.

4. The metering valve of claim 3, wherein said communicating means further includes:

a passage communicating at one end with said one port, said passage blocked from communication at another end with said bore and said return passage by said second land when said spool is in said first position and connected with said bore and said return passage in response to said diagonal shoulder uncovering said another end of said passage.

5. The metering valve of claim 4, wherein said one port is said outlet port and said inlet port is in communication with said passage means independent of the position of said spool in said bore.

6. The metering valve of claim 4, wherein said passage means in said spool completely traverses said one port when moving along said path between said first and second positions and said second land blocks communication between said passage means and said one port when said spool is in said second position.

7. A metering valve comprising:

a valve housing having a fluid inlet port, a fluid outlet port, a fluid return passage, and a bore;

a spool valving member disposed in said bore and axially moveable between first and second positions, passage means in said spool having at least one opening sealed from communication with one of said ports and from said return passage when said valving member is in said first position and registering with said one port to define a continuous passage through said valve housing by serially connecting said inlet port, said passage means, and said outlet port when said valving member is moving between said first and second positions;

means for moving said valving member from said first position to said second position; means for communicating said at least one opening with said return passage at some point during the time said at least one opening is registering with said one port, whereby said inlet port is communicated solely with said outlet port during part of the registering time and is also communicated with the return passage during the rest of the registering time, and means for varying the point at which said at least one opening is communicated with said return passage.

8. A metering valve for a fuel injection syetem of the type including a source of pressurized fuel, a nozzle for delivering the pressurized fuel to a piston cylinder of an internal combustion engine, means for communicating the source with the nozzle, and distributor means for blocking and unblocking said communicating means in a timed relation to the cyclic operation of said engine, said metering valve comprising:

a valve housing having a fuel inlet port connected to said source by said communicating means, a fuel outlet port connected to said nozzle by said communicating means, and a fuel return passage;

a valving member moveable in said housing along a path extended from a first position in which it blocks communication between said ports to a second position;

means operative to move said valving member from said first position to said second position at velocities independent of the speed of said engine;

passage means in said valving member operative at some point during movement of said valving member along said path to define a continuous passage through said valve housing by serially connecting said inlet port, said passage means, and said outlet port at the same time said distributor means unblocks said communicating means;

means for connecting one of said ports with said return passage at some point during such movement; and means for varying the point along said path at which said port is connected with said return passage.

9. The metering valve of claim 8, wherein said operative means moves said valving member at the same velocities over the operating range of said engine; and said distributor means unblocks said communicating means while said spool is moving along said path from said first position to said second position.

10. The metering valve of claim 7, wherein:

said valve housing includes a bore and said inlet and outlet ports and said return port communicate with said bore;

said valving member is a spool valving member having first and second lands in slideable sealing contact with the wall of said bore and axially spaced apart by said passage means in said spool, said first land operative to block communication between said passage means and one of said ports when said spool is in said first position and said second land operative to block communication between said one port and said return passage when said spool is in said first position;

said connecting means including a diagonal shoulder defined by said second land and operative to communicate said one port to return at some point during axial movement of said spool along said path; and said varying means includes means for varying the rotational position of said spool in said bore, thereby varying the point said diagonal shoulder connects said one port to return while said spool is moving axially along said path.

11. The metering valve of claim 10, wherein said connecting means further includes:

a passage communicating at one end with said one port, said passage blocked from communication at another end with said bore and said return passage by said second land when said spool is in said first position and connected with said bore and said return passage in response to said diagonal shoulder uncovering said another end of said passage.

12. The metering valve of claim 11, wherein said one port is said outlet port and said inlet port is in communication with said passage means independent of the position of said spool in said bore.

13. The metering valve of claim 11, wherein said means operative moves said valving member at the same velocities over the operating range of said engine.

14. The metering valve of claim 13, wherein said passage means in said spool completely traverses said one port when moving along said path between said first and second positions and said second land blocks communication between said passage means and said one port when said spool is in said second position.

15. A fluid metering valve comprising:

a valve housing having an inlet port adapted for connection to a source of pressurized fluid, a fluid outlet port adapted for connection to means operative to pass fluid above a predetermined pressure, and a fluid return passage;

a valving member moveable in said housing between first and second positions, said valving member operative when in said first position to block communication from said inlet port to said outlet port and from either of said ports to said return passage;

passage means in said valving member for metering fluid from said inlet port to said outlet port, said passage means operative at some point during movement of said valving member from said first position to said second position to define a continuous passage through said valve housing and meter said fluid to said outlet port by serially connecting said inlet port with said outlet port via said passage means; and means for dumping the pressure of the metered fuel in said outlet port by connecting said outlet port to said return passage, said dumping means including a second fluid return passage in said valve housing in continuous communication with said outlet port and opening into said bore, and land means defined by said valving member for blocking said opening when said valving is in said first position and for unblocking said opening and communicating said outlet port to said first mentioned return passage at some point during movement of said valving from said first position to said second position.

16. The fluid metering valve of claim 15, further including:

means for varying the point at which said land means unblocks said opening, whereby the volume of fluid flowing to the means operative to pass fluid is varied.

17. The metering of claim 16, further including:

actuation means operative to always move said valving member from said first position to said second position at the same velocities, whereby the traversing time of said passage means opening across said outlet port opening is always the same.

18. The metering valve of claim 16, wherein said metering valve meters fuel for an internal combustion engine operated over a range of speeds and said valve further including:

actuation means for moving said valving member from said first position to said second position at velocities independent of engine speed.

19. The metering valve of claim 18, wherein:

said actuation means always moves said valving member from said first position to said second position at the same velocities over the operating speed range of said engine.

20. A fluid metering valve comprising:

a valve housing having a bore, an inlet port opening into said bore, an outlet port opening into said bore, a first return passage opening into said bore, and a second return passage in continuous communication with said outlet port and opening into said bore;

a valving member axially moveable in said bore between first and second positions, which positions both blocks communication between said ports;

passage means in said valving member having an opening operative to completely traverse said outlet port opening during movement of said valving member between said first and second positions for metering fluid to said outlet port during said traversing;

a first land defined by said valving member and operative to block communication between said passage means opening and said outlet passage opening when said valving member is in said first position;

a second land defined by said valving member and axially spaced from said first land by said passage means opening, said second land operative to block communication between said return passages when said valving member is in said first position and operative to block communication between said passage means opening and said outlet port opening when said valving member is in said second position;

second passage means defined by said valving member for communicating said first return passage with said second return passage during movement of said valving member from said first position to said second position, said second passage means including a shoulder oblique to the longitudinal axis of said valving member; and means operative to vary the rotational position of said valving member in said bore for controlling the point said oblique shoulder communicates said first return passage with said second return passage via said second passage means as said valving member moves from said first position to said second position.

21. The metering valve of claim 20, further including:

actuation means operative to always move said valving member from said first position to said second position at the same velocities, whereby the traversing time of said passage means opening across said outlet port opening is always the same.

22. The metering valve of claim 20, wherein said metering valve meters fuel for an internal combustion engine operated over a range of speeds and said valve further including:

actuation means for moving said valving member from said first position to said second position at velocities independent of engine speed.

23. The metering valve of claim 22, wherein:

said actuation means always moves said valving member from said first position to said second position at the same velocities over the operating speed range of said engine.

* * * * *

UNITED STATES PATENT AND TRADEMARK OFFICE

CERTIFICATE OF CORRECTION

PATENT NO. : 4,033,314

DATED : 7/5/77

INVENTOR(S) : Erlen B. Walton

It is certified that error appears in the above-identified patent and that said Letters Patent are hereby corrected as shown below:

| | |
|---|---|
| Col. 1, line 25: | "389,391" should read "689,391". |
| Col. 3, line 8: | (not shown) should be inserted after "R42 rather than after R32. |
| Col. 6, line 29: | "When" is misspelled. |

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*